United States Patent [19]

Yano et al.

[11] Patent Number: 4,553,510

[45] Date of Patent: Nov. 19, 1985

[54] CYLINDER HEAD FOR INTERNAL COMBUSTION ENGINES

[75] Inventors: Yoshiki Yano, Saitama; Yuji Kawaguchi, Tokyo, both of Japan

[73] Assignee: Honda Giken Kogyo Kabushiki Kaisha, Tokyo, Japan

[21] Appl. No.: 545,905

[22] Filed: Oct. 27, 1983

[30] Foreign Application Priority Data

Oct. 27, 1982 [JP] Japan ..... 57-162731[U]

[51] Int. Cl.[4] ..... F01M 1/06

[52] U.S. Cl. ..... 123/90.34; 123/196 M; 123/195 A; 123/90.27; 184/6.5

[58] Field of Search ..... 123/196 R, 196 M, 195 R, 123/195 A, 90.33, 90.34, 90.27, 508, 146.5 A; 184/6.5

[56] References Cited

U.S. PATENT DOCUMENTS 4,223,567 9/1980 Onda ..... 123/195 A
4,333,433 6/1982 Mattson ..... 123/146.5 A
4,391,258 7/1983 Claesson ..... 123/508
4,436,067 3/1984 Fritzenwenger ..... 123/195 A
4,466,409 8/1984 Asaka et al. ..... 123/90.27

*Primary Examiner*—E. Rollins Cross
*Attorney, Agent, or Firm*—Lyon & Lyon

[57] ABSTRACT

A cylinder head for an internal combustion engine is constructed with a camshaft holder assembly. The camshaft holder assembly consists of several cylindrical recesses which form the camshaft support bearing, the camshaft positioning guide, and an accommodating chamber. Lubricant flows through the camshaft support bearing and accumulates in the accommodating chamber, which encloses a coupling between the camshaft and the drive shaft of an auxiliary device, for lubricating and cooling the coupling. The lubricant is maintained at a relatively constant level in the accommodating chamber by an inclined flow passage to the lubricant return passage in the cylinder head and the splashing action of the coupling within the accommodating chamber.

10 Claims, 4 Drawing Figures

CYLINDER HEAD FOR INTERNAL COMBUSTION ENGINES

The present invention relates to a cylinder head for an internal combustion engine and, more particularly, to a cylinder head for an internal combustion engine which is equipped with an auxiliary device designed to be directly connected to and driven by an overhead camshaft, and a method for lubricating the essential elements of such a combination.

The drive shaft of the auxiliary device is coupled through a coupling member, such as an Oldham's Coupling, to the end portion of the camshaft, which is arranged on the upper face of the cylinder head, so that the rotations of the camshaft are directly transmitted to the drive shaft of the auxiliary device, thereby driving the same. The coupling portion between the camshaft and the auxiliary device drive shaft is fed with a lubricant to prevent overheating and excessive wear of the components.

The prior art requires lubrication passages to be specially formed in the cylinder head of the engine so that the camshaft support bearing and the coupling portion between the camshaft and the auxiliary device drive shaft may be lubricated. This makes the construction of the cylinder head more complex and increases the number of manufacturing working steps. The net result is a more expensive product due to the special manufacturing processes involved.

The object of the present invention is to provide a cylinder head for an internal combustion engine which permits continuous lubrication of the camshaft support bearing and the coupling between the camshaft and the drive shaft of the auxiliary device, without increasing the difficulty or cost of manufacturing such a cylinder head. In order to achieve that object there is provided a cylinder head for an internal combustion engine, in which an overhead camshaft is supported at one end by a camshaft bearing portion formed on the upper face of the cylinder head, which mounts on to the internal combustion engine, and on which the body of the auxiliary device to be driven by the camshaft is fitted and mounted.

The camshaft holder has an internal chamber for accommodating the coupling between the camshaft and the drive shaft of the auxiliary device. The accommodating chamber is located between the camshaft bearing portion of the cylinder head and the body of the auxiliary device. Lubricant is allowed to flow through the camshaft bearing portion area to the accommodating chamber. The lubricant is then contained in the accommodating chamber to lubricate the coupling portion. A passage is provided for the excess lubricant to flow back to the main reservoir. This eliminates the need for separate lubricant feeding passages to the camshaft support bearing and the coupling between the camshaft and the drive shaft of the auxiliary device.

Other and more detailed objects and advantages of this invention will appear from the accompanying drawings wherein.

Figure 1:
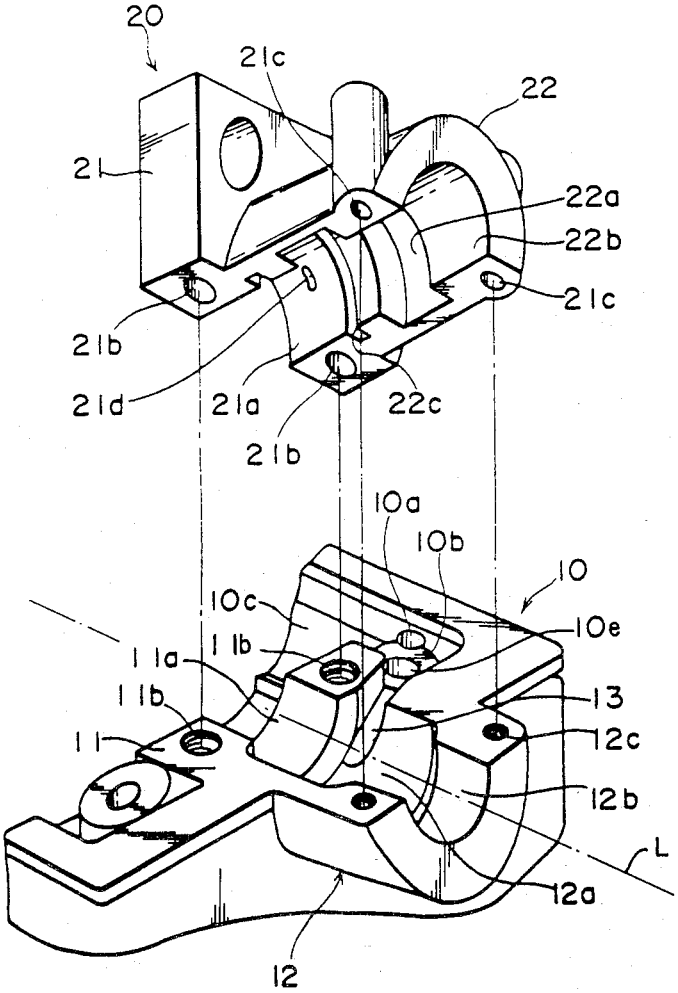
FIG. 1 is an exploded perspective view, showing the camshaft holder and the essential portion of the cylinder head for the embodiment of the present device.
Figure 2:
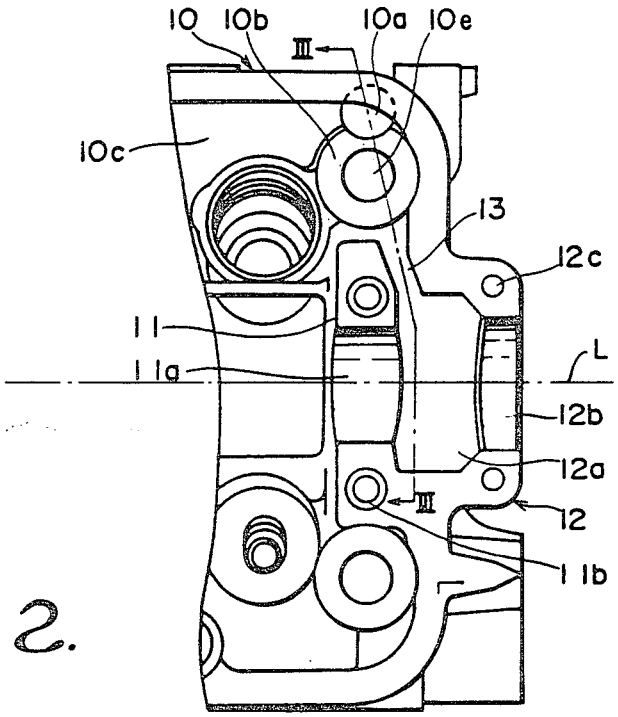
FIG. 2 is a top plan view of the portion of the cylinder head shown in FIG. 1.

As shown in FIGS. 1 and 2, a camshaft mounting portion 11 of the cylinder head 10 is formed with a semi-cylindrical camshaft bearing portion 11*a* whose longitudinal axis is in the same direction as the longitudinal axis L of the cylinder head 10. The camshaft mounting portion 11 has a side portion formed with a semi-cylindrical protrusion 12 which extends outwardly from the base of said mounting portion 11, coaxially with the aforementioned bearing portion 11*a*. A semi-cylindrical recess 12*a* and a semi-cylindrical fitting portion 12*b*, each with a predetermined radii, are formed within the protrusion 12. The longitudinal axis of each is aligned coaxially with the longitudinal axis of the camshaft bearing portion 11*a*. The radius and axial width of the semi-cylindrical recess 12*a* are formed to have predetermined larger sizes than the respective radii and axial widths of the aforementioned camshaft bearing portion 11*a* and fitting portion 12*b*.

Figure 3:
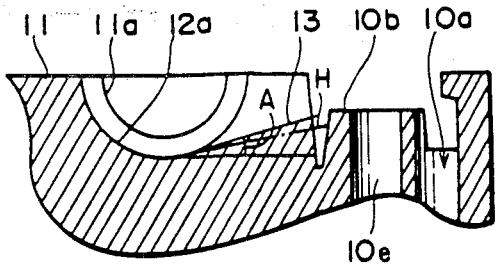
FIG. 3 is a section taken along line III—III of FIG. 2.

In one side end portion of the aforementioned recess 12*a*, as shown in FIGS. 1 and 3, there is formed an oil guide groove 13 which is sloped at a predetermined angle A with respect to the cylinder head upper face 10*c*. Angle A is large enough so that the oil guide groove 13 is inclined both as to the upper face of the cylinder head 10*c* and the horizontal H when the cylinder head 10 is mounted on the engine. The oil guide groove 13 faces an oil return hole 10*a* formed in the upper face 10*c* of the cylinder head 10.

A boss portion 10*b* is formed to extend vertically upward from the upper face 10*c* of the cylinder head 10 by a predetermined amount and a bolt (not-shown) is inserted into the hole 10*e* to fixedly fasten the cylinder head 10 to a cylinder block (not shown). The oil return hole 10*a* is formed adjacent to the aforementioned boss portion 10*b* between the boss portion 10*b* and the outer wall of the cylinder head 10, as shown in FIG. 3. The oil return hole 10*a* thus formed allows the lubricant to flow back to the inside of a lubricant reservoir by way of a passage which is formed in the cylinder head 10 and the cylinder block wall.

Figure 4:
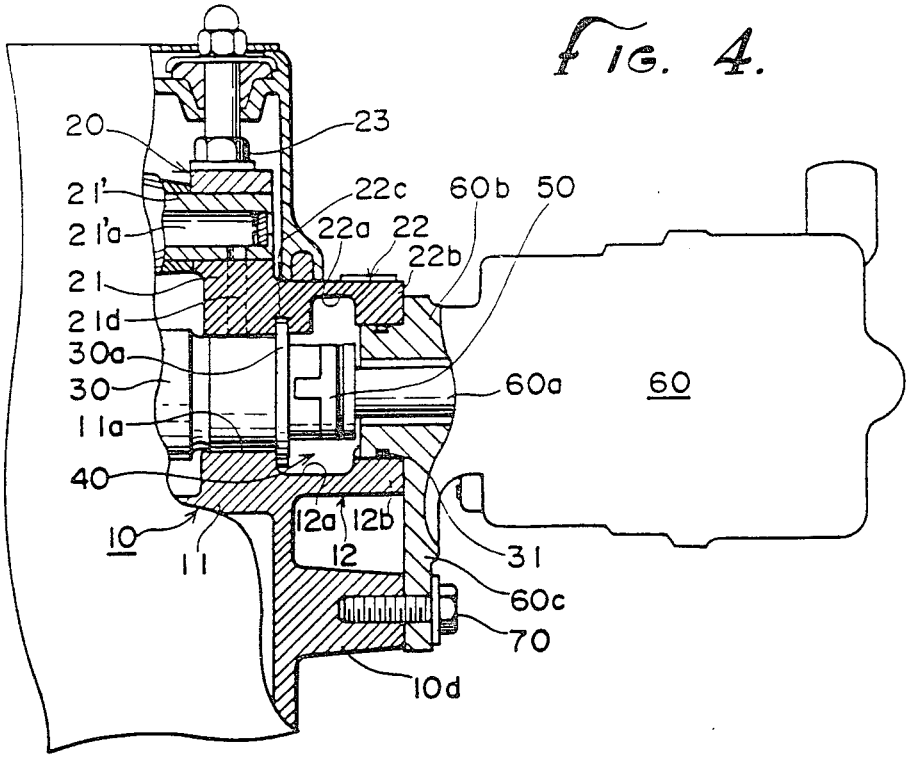
FIG. 4 is a partially sectional side view showing an auxiliary device mounted on the cylinder head of FIGS. 1 and 2.

A camshaft holder 20 is formed, as shown in FIGS. 1 and 4, by a camshaft holder body 21 and a protrusion 22 which corresponds to the camshaft mounting portion 11 and the protrusion 12, respectively. The camshaft holder body 21 is formed with a semi-cylindrical camshaft bearing portion 21*a* which corresponds to the aforementioned camshaft bearing portion 11*a*, whereas the protrusion 22 is formed with a semi-cylindrical recess 22*a* and a semi-cylindrical fitting portion 22*b* which correspond to the semi-cylindrical recess 12*a* and the semi-cylindrical fitting portion 12*b* of the aforementioned protrusion 12, respectively. A semi-circular groove 22*c* having a predetermined width is formed coaxially with, and adjacent to, the camshaft bearing portion 21*a* and the semi-cylindrical recess 22*a*. Additionally, the camshaft holder body 21 is formed with a port 21*d* which allows lubricant to flow between the oil passage 21′*a* of a rocker shaft 21′ and the bearing portion 21*a* arranged in the upper portion of the camshaft holder body 21 under consideration.

The camshaft holder body 21 is arranged such that the camshaft bearing portion 21*a* of the camshaft holder body 21 and the camshaft bearing portion 11*a* of the camshaft mounting body 11 form an enclosure to support one end of the camshaft 30. In addition, the camshaft holder protrusion 22 recess 22*a* and fitting portion 22*b* form cylindrical enclosures with the recess 12*a* and the fitting portion 12*b* of the camshaft mounting protrusion 12, respectively, except that the camshaft mounting protrusion recess 12*a* has sufficient longitudinal length to form a cylindrical enclosure with the semi-circular groove 22*c* in the camshaft holder protrusion 22. The camshaft holder 20 is fixedly connected to the camshaft mounting portion 11 and the protrusion 12 by means of bolts which are inserted into bolt holes 21*b* and 21*c* of the camshaft holder 20 and screwed in threaded holes 11*b* and 12*c* of the camshaft mounting portion and the protrusion 12, respectively. Thus, the camshaft 30 has its one end borne by means of the camshaft bearing portions 11*a* and 21*a*, and an accommodating chamber 40 is formed by the recesses 12*a* and 22*a*. A flange 30*a* formed on the camshaft 30 fits in the enclosure formed by the semicircular groove 22*c* in the camshaft holder protrusion 22 and the recess 12*a* in the camshaft mounting protrusion 12*a* to maintain the position of the camshaft 30 with respect to the cylinder head 10.

An auxiliary device 60 has its body fitting portion 60*b* fitted liquid-tight by means of an O-ring 31 in the fitting hole which is formed by the respective fitting portions 12*b* and 22*b* of the camshaft mounting protrusion 12 and the camshaft holder 20 protrusion 22. The auxiliary device mounting portion 60*c*, formed on the lower portion of the fitting portion 60*b*, is fixedly fastened by means of bolts 70 in a frusto-conical seat 10*d* which is formed in a predetermined portion of the outer wall of the cylinder head 10 such that the auxiliary device 60 is fixed to one side end portion of the cylinder head 10.

The end portion of the camshaft 30 and the end portion of the drive shaft 60*a* of the auxiliary device 60 are directly connected by means of a coupling 50, for example an Oldham's Coupling, in the accommodating chamber 40. The accommodating chamber 40 constitutes a reservoir for the lubricant and has its side portion opened through the oil guide groove 13 (as shown in FIGS. 1 to 3).

In the cylinder head having the construction thus far described, the lubrication of the coupling portion between the camshaft 30 and the drive shaft 60*a* of the auxiliary device 60 is conducted in the following manner. As shown in FIG. 4, the lubricant, which is fed from the conventional oil pan to the passage 21′*a* in the rocker arm support shaft 21′ in a conventional manner, flows to the surface of the camshaft 30 from that passage via the port 21*d* in the camshaft holder body 21. The lubricant will thereby lubricate the respective contact faces of the camshaft 30 and the camshaft bearing portions 11*a* and 21*a*. It then flows in the axial direction of the camshaft 30, past the positioning flange and towards the accommodating chamber 40 until it leaks into the accommodating chamber 40 where it is retained and thereby lubricates the coupling portion between the camshaft 30 and the drive shaft 60*a* of the auxiliary device 60.

The lubricant contained in the accommodating chamber 40 flows into the oil guide groove 13 up the inclined channel towards the boss portion 10*b*, as shown in FIGS. 2 and 3. It then flows over the bolt head (not shown) fitted in the hole 10*c* of the aforementioned boss portion 10*b*, or around the base of said boss portion 10*b*, thus flowing on the upper face 10*c* of the cylinder head 10, until it flows into the oil return hole 10*a*. Since the oil guide groove 13 is sloped uphill towards the oil return hole 10*a*, and since the rotation of the coupling 50 is in a direction tending to prohibit the lubricant flow towards the lubricant return hole 10*a*, the lubricant is prevented from completely draining out of the aforementioned accommodating chamber 40. The lubricant that flows into the lubricant return hole 10*a* is returned to the lubricant reservoir by way of a passage in the cylinder head 10 and the cylinder block.

This lubricating system allows for the proper amount of lubricant to be retained in the accommodating chamber 40 to lubricate the coupling 50 enclosed therein, and prevents external leakage of excess lubricant by maintaining a constant level of lubricant in the accommodating chamber.

This design makes it unnecessary to provide a new lubricant feeding passage or the like in the cylinder head and makes it possible to simplify the manufacture of the cylinder head.

We claim:

1. A cylinder head for an internal combustion engine which incorporates an overhead camshaft and an auxiliary device designed to be attached onto the end of the camshaft through a coupling, comprising, a camshaft support assembly with an upper and lower portion and means to attach the same, a lubricant inlet portion and cylindrical recesses in said assembly to provide a camshaft support bearing and to form an enclosure around the coupling, and a groove formed in said enclosure portion of said assembly leading to another portion to allow the excess lubricant to return to its source.

2. The cylinder head as set forth in claim 1 in which said enclosure around the coupling is formed between the camshaft support bearing formed by said assembly and the body of the auxiliary device, and said lubricant inlet port is formed in said upper portion of the camshaft support assembly, and said groove has an angle of inclination which is positive relative to the horizontal plane when the cylinder head is mounted on the internal combustion engine.

3. A cylinder head for an internal combustion engine with an upper face, utilizing an overhead camshaft and an auxiliary device whose drive shaft is designed to be attached directly to the end of the camshaft through a coupling, comprising, a camshaft mounting portion formed on the upper face of the cylinder head, a camshaft holder portion and means to attach said holder portion to said mounting portion thus forming a camshaft support bearing, a cylindrical recess formed within said mounting and holder portions to accommodate the coupling between the camshaft and the drive shaft of the auxiliary device, an upwardly inclined oil guide groove leading from said recess to an oil return hole formed in the upper face of the cylinder head which allows lubricant to flow from the camshaft support bearing into said coupling accommodation recess where it is retained for lubricating the coupling before the excess flows out said groove.

4. The cylinder head as set forth in claim 3 in which said recess which encloses the coupling is formed between the camshaft support bearing of said assembly and the body of the auxillary device, and said inclined oil guide groove has an angle of inclination which is positive relative to the horizontal plane when the cylinder head is mounted on the internal combustion engine.

5. A cylinder head for an internal combustion engine with an upper face and lubricant flow passages, which utilizes an overhead camshaft and camshaft support bearings and an auxiliary device which is directly connected to the camshaft through a coupling, comprising, a camshaft support assembly consisting of an upper and lower portion and means to connect the same, said lower portion of the assembly formed on the upper face of the cylinder head, cylindrical cavities formed within said assembly thereby forming the camshaft support bearing and an enclosure around the coupling, a passage formed in the upper portion of the camshaft support assembly which allows lubricant to flow from the lubricant flow passage in the cylinder head into said cylindrical cavities within said camshaft support assembly, and an inclined channel which runs from said cylindrical cavity contained within the camshaft support assembly to the upper face of the cylinder head and to a lubricant return passage formed in the upper face of the cylinder head.

6. The cylinder head as set forth in claim 5 in which a cylindrical groove is formed in said camshaft support assembly to maintain the camshaft positioning relative to the cylinder head, and said enclosure for the coupling is formed between the camshaft support bearing and the body of the auxiliary device, and said inclined channel has an angle of inclination which is positive relative to the horizontal plane when the cylinder head is mounted on the internal combustion engine.

7. A cylinder head for an internal combustion engine with an upper face and lubricant flow passages, which utilizes an overhead camshaft and camshaft support bearings, and an auxiliary device whose drive shaft is directly connected to the camshaft through a coupling, comprising, a camshaft support assembly consisting of an upper portion and means to attach the same, said lower portion of said assembly formed on the upper face of the cylinder head, cylindrical cavities formed within said assembled camshaft support assembly, said cavities having different axial and radial lengths, a passage in said upper portion of said assembly to allow lubricant to flow from the lubricant flow passage into said cylindrical cavity with the smallest radial length, wherein a camshaft support bearing is formed, and an inclined channel which runs from said cylindrical cavity of greatest radial length, wherein the coupling is enclosed, to the upper face of the cylinder head and to a lubricant return passage formed on the upper face of the cylinder head.

8. The cylinder head as set forth in claim 7 in which a cylindrical groove is formed in said camshaft support assembly to maintain the camshaft positioning relative to the cylinder head, and said cavity which encloses the coupling is formed between the camshaft support bearing of said camshaft support assembly and the body of the auxiliary device, and said inclined channel has an angle of inclination which is positive relative to the horizontal plane when the cylinder head is mounted on the internal combustion engine.

9. A cylinder head for an internal combustion engine with an upper face and lubricant flow passages, which utilizes an overhead camshaft and camshaft support bearings, a circular flange for maintaining the axial position of the camshaft and an auxiliary device which is directly connected to the camshaft through a coupling, comprising, a camshaft support assembly consisting of an upper and lower portion and means to connect the same, said lower portion of said assembly formed on the upper face of the cylinder head, cylindrical cavities formed within said assembly, said cavities having different axial and radial lengths, a lubricant flow passage formed within said upper portion of said assembly to allow lubricant to flow from the cylinder head lubricant flow passage into said cylindrical cavity with the smallest radial length which forms a camshaft support bearing, a second cavity adjacent to the first said cavity enclosing the camshaft positioning flange, a third cavity adjacent to said camshaft positioning flange cavity and having the greatest radial length, said third cavity enclosing the coupling, and an inclined channel which runs from the base of said third cavity enclosing the coupling to the upper face of the cylinder head and to a lubricant return passage formed in the upper face of the cylinder head.

10. A cylinder head for an internal combustion engine with an upper face and lubricant flow passages, which utilizes an overhead camshaft and camshaft support bearings, a circular flange for maintaining the axial position of the camshaft and an auxiliary device which is directly connected to the camshaft through a coupling, comprising, a camshaft support assembly consisting of an upper and lower portion and means to connect the same, said lower portion of said assembly formed on the upper face of the cylinder head, cylindrical cavities formed within said assembly, said cavities having different axial and radial lengths, a lubricant flow passage formed within said upper portion of said assembly to allow lubricant to flow from the cylinder head lubricant flow passage into said cylindrical cavity with the smallest radial length, which forms a camshaft support bearing, a second cavity adjacent to the first said cavity enclosing the camshaft positioning flange, a third cavity adjacent to said camshaft positioning flange cavity and having the greatest radial length, said third cavity encloses the coupling and is formed between the camshaft support bearing and the body of the auxiliary device, and an inclined channel which runs from the base of said third cylindrical cavity enclosing the coupling to the upper face of the cylinder head and to a lubricant return passage formed in the upper face of the cylinder head, said inclined channel having an angle of inclination which is positive relative to the horizontal plane when the cylinder head is mounted on the internal combustion engine.

* * * * *